US005582567A

United States Patent [19]

Chang

[11] Patent Number: 5,582,567

[45] Date of Patent: Dec. 10, 1996

[54] ROCKING TYPE EXERCISER

[76] Inventor: Kuo-hsing Chang, No. 4, Lane 97, Hsinhsing Rd., Shenkang Hsiang, Taichung Hsien, Taiwan

[21] Appl. No.: 604,411

[22] Filed: Feb. 21, 1996

[51] Int. Cl.[6] ..... A63B 22/16

[52] U.S. Cl. ..... 482/146; 482/71; 482/132

[58] Field of Search ..... 482/146, 132, 482/71, 121, 122, 123; 280/87.041, 87.042

[56] References Cited

U.S. PATENT DOCUMENTS

| | | | |
|---|---|---|---|
| 735,319 | 4/1903 | Urwick | 482/146 |
| 2,906,532 | 9/1959 | Echols | 482/146 |
| 3,582,066 | 6/1971 | Keryluk | 482/71 |
| 3,834,693 | 9/1974 | Poppenberger | 482/71 |
| 4,744,576 | 5/1988 | Scollan, Jr. | 482/71 |

*Primary Examiner*—Lynne A. Reichard
*Attorney, Agent, or Firm*—William E. Pelton

[57] ABSTRACT

An exerciser includes a base member having a plurality of supporting beams each having two distal ends. A plurality of rollers are each rotatably mounted on each of the two distal ends of each of the plurality of supporting beams. A rocking member is rotatably mounted on the base member and includes a plurality of arcuate tracks each rotatably mounted between the rollers on each distal end of a corresponding one of the plurality of supporting beams. A pedal board is fixedly mounted on the rocking member to rotate therewith.

6 Claims, 5 Drawing Sheets

ROCKING TYPE EXERCISER

FIELD OF THE INVENTION

The present invention relates to an exerciser, and more particularly to a rocking type exerciser.

BACKGROUND OF THE INVENTION

In our daily routine work, those people in sedentary occupations seldom exercise their limbs because they are seated for most of the time.

The present invention has arisen to provide a rocking type exerciser suitable for a user so that he or she may exercise indoors.

SUMMARY OF THE INVENTION

The primary objective of the present invention is to provide a rocking type exerciser suitable for a user to efficiently exercise waist and leg muscles.

In accordance with one aspect of the present invention, there is provided an exerciser comprising a base member including a plurality of supporting beams each having two distal ends. A plurality of rollers are each rotatably mounted on each of the two distal ends of each of the plurality of supporting beams. A rocking member is rotatably mounted on the base member and includes a plurality of arcuate tracks each rotatably mounted between the rollers on each distal end of a corresponding one of the plurality of supporting beams. A pedal board is fixedly mounted on the rocking member to rotate therewith.

Further features of the present invention will become apparent from a careful reading of the detailed description with reference to the accompanying drawings.

DETAILED DESCRIPTION OF THE PREFERRED EMBODIMENTS

Figure 1:
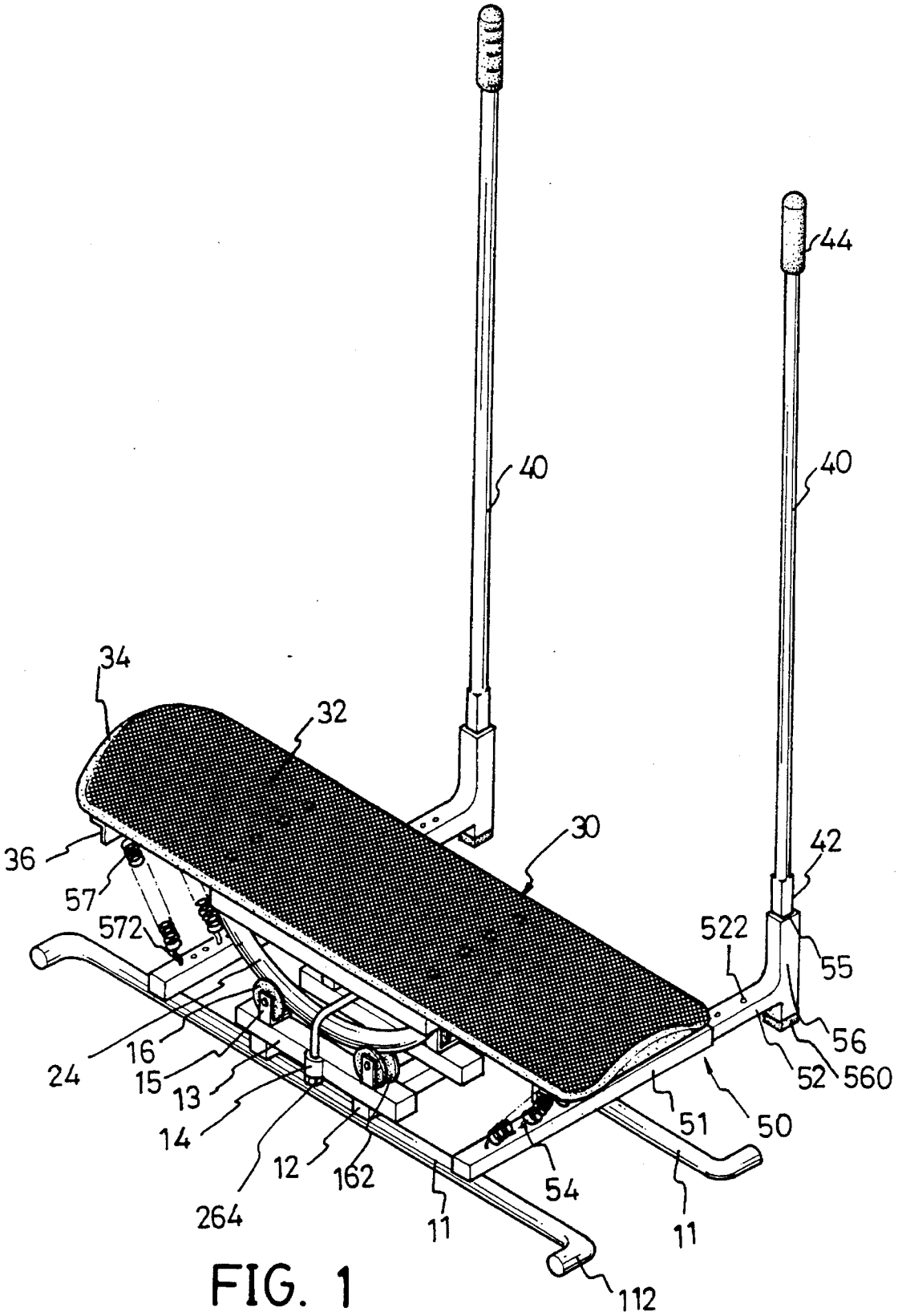
FIG. 1 is a perspective view of a rocking type exerciser in accordance with the present invention.
Figure 2:
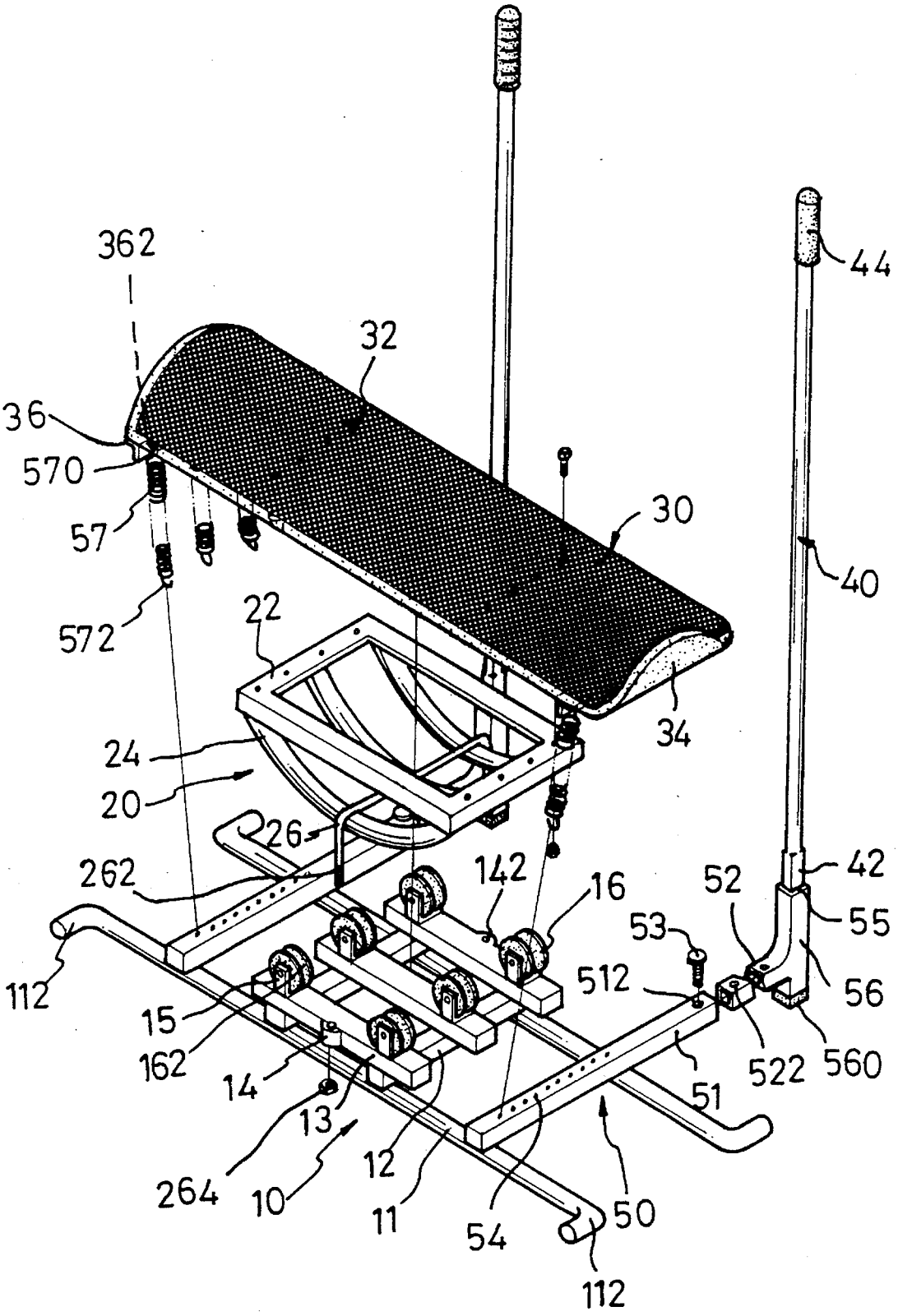
FIG. 2 is an exploded view of FIG. 1.

Referring to the drawings, and initially to FIGS. 1 and 2, a rocking type exerciser in accordance with the present invention comprises a base member 10 including a plurality, preferably three, of supporting beams 13 each having two distal ends. A plurality of rollers 16 are each rotatably mounted on each of the two distal ends of each of the three supporting beams 13. A rocking member 20 is rotatably mounted on the base member 10 and includes a plurality, preferably three, of arcuate tracks 24 each rotatably mounted between the rollers 16 on each distal end of a corresponding one of the three supporting beams 13. A pedal board 30 is fixedly mounted on the rocking member 20 to rock therewith.

Figure 3:
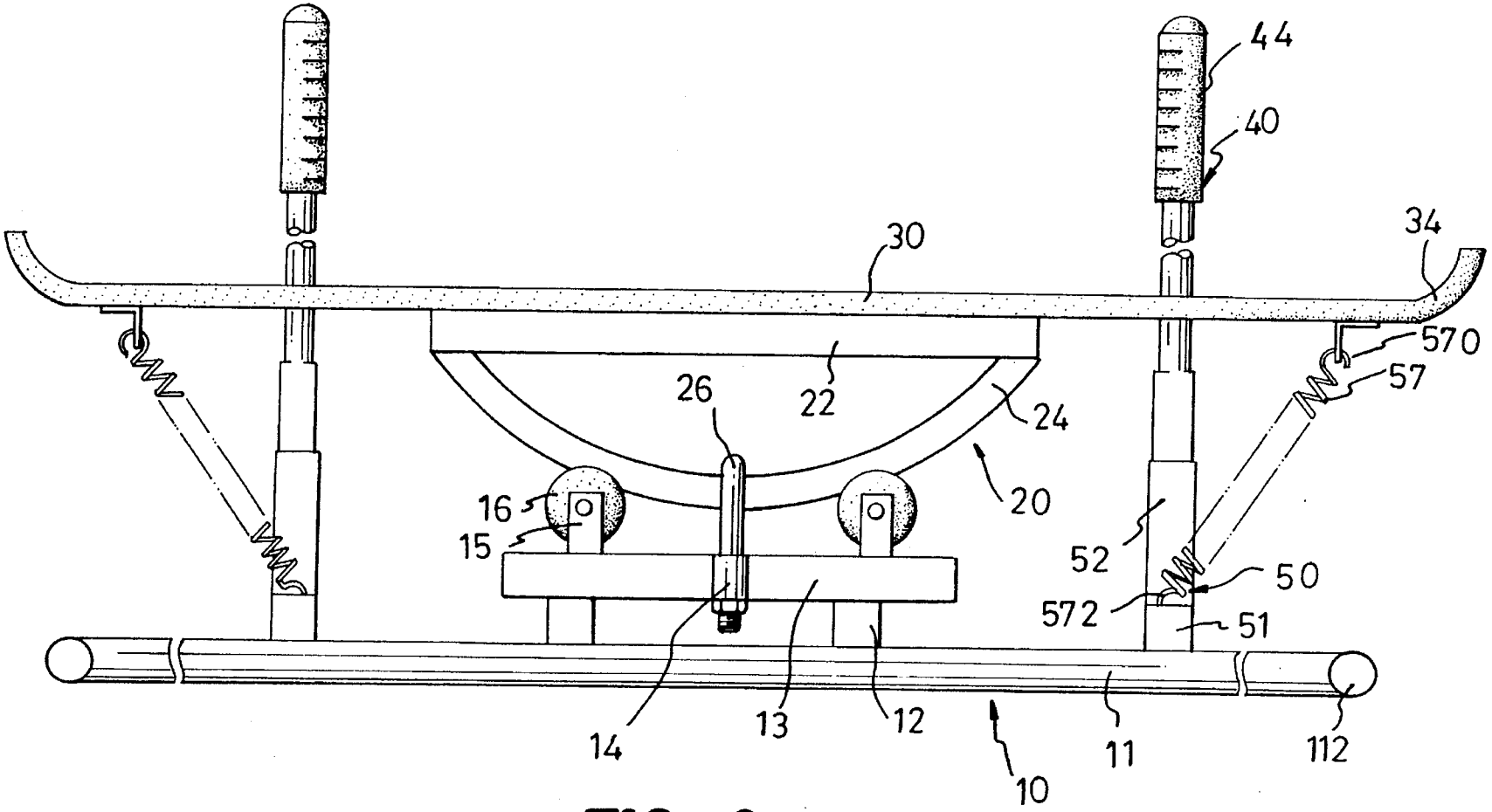
FIG. 3 is a front plan view of FIG. 1.
Figure 4:
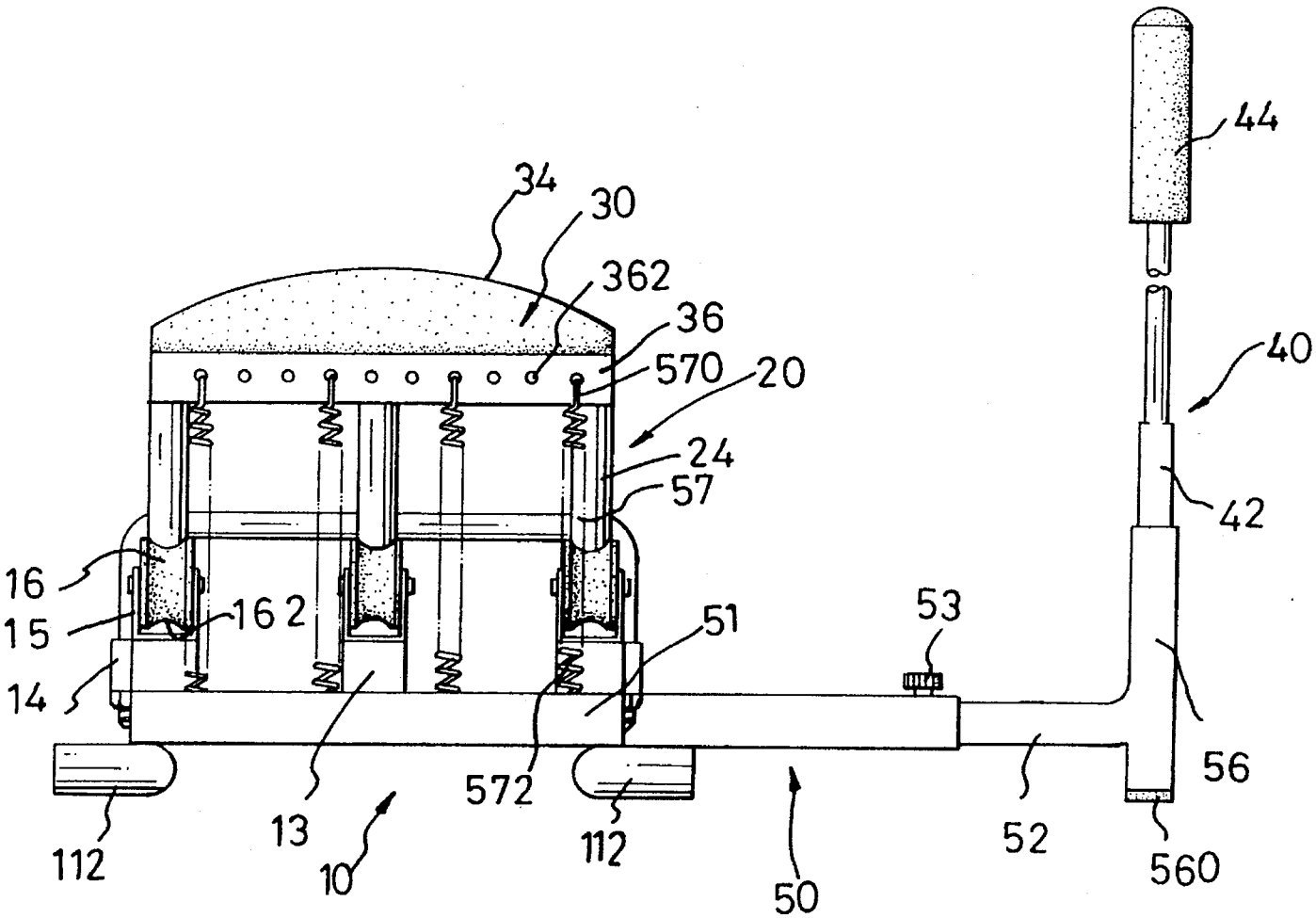
FIG. 4 is a side plan view of FIG. 1.

In practice, referring to FIGS. 1 and 2 with reference to FIGS. 3 and 4, the base member 10 includes two base beams 11 mounted in parallel with each other and each having two perpendicular distal ends 112. A plurality, preferably two, of resting bars 12 are each transversely mounted between the supporting beams 13 and the base beams 11.

A plurality of U-shaped brackets 15 are each fixedly mounted on each of the two distal ends of each of the three supporting beams 13 for holding an associated roller 16 therein. Each of the rollers 16 has an annular groove 162 for receiving an associated arcuate track 24. An ear 14 having a hole 142 vertically defined therethrough is laterally formed on each of the two outermost supporting beams 13.

The rocking member 20 includes a rectangular frame 22 mounted on the three arcuate tracks 24 and fixedly mounted on an underside of the pedal board 30 by means of such as threaded engagement or adherence. The pedal board 30 has a plurality of bosses 32 formed on an upperside thereof for improving traction between it and a user's feet. Preferably, the pedal board 30 has two perpendicular distal ends 34.

The rocking member 20 includes an inverted U-shaped brace 26 transversely mounted on the three arcuate tracks 24 and having two threaded distal ends 262 each extending through a corresponding one of the two holes 142 and each threadedly engaged with an associated nut 264.

Two positioning members 50 each includes an outer fitting beam 51 transversely and fixedly mounted on one end portion of the two base beams 11 of the base member 10, an inner fitting beam 52 adjustably mounted in one distal end of the outer fitting beam 51, and an upright post 56 formed on one distal end of the inner fitting beam 52.

A plurality of holes 54 are defined in each of the two outer fitting beams 51 which each have a bore 512 defined in the distal end thereof. Each of the two inner fitting beams 52 has a plurality of bores 522 threadedly defined therein one of which aligns with an associated bore 512. Two adjusting screws 53 each extend through associated bores 512 and 522 such that each of said two inner fitting beams 52 is adjustably mounted in the associated outer fitting beam 51.

Two vertical handles 40 each have a lower end 42 fixedly mounted on an upper end 55 of the upright post 56 which has a buffer pad 560 mounted on an underside thereof. A handgrip pad 44 is mounted on an upper end of each of the two vertical handles 40.

Two substantially L-shaped retaining members 36 each have a horizontal section fixedly and transversely mounted on one end portion of the underside of the pedal board 30 and a vertical section having a plurality of holes 362 transversely defined therein. A plurality of biasing members or springs 57 each have a first distal end 570 fixedly attached to an associated hole 362 of each of the two retaining members 36 and a second distal end 572 fixedly received in an associated hole 54 of each of the two outer fitting beams 51.

Figure 5:
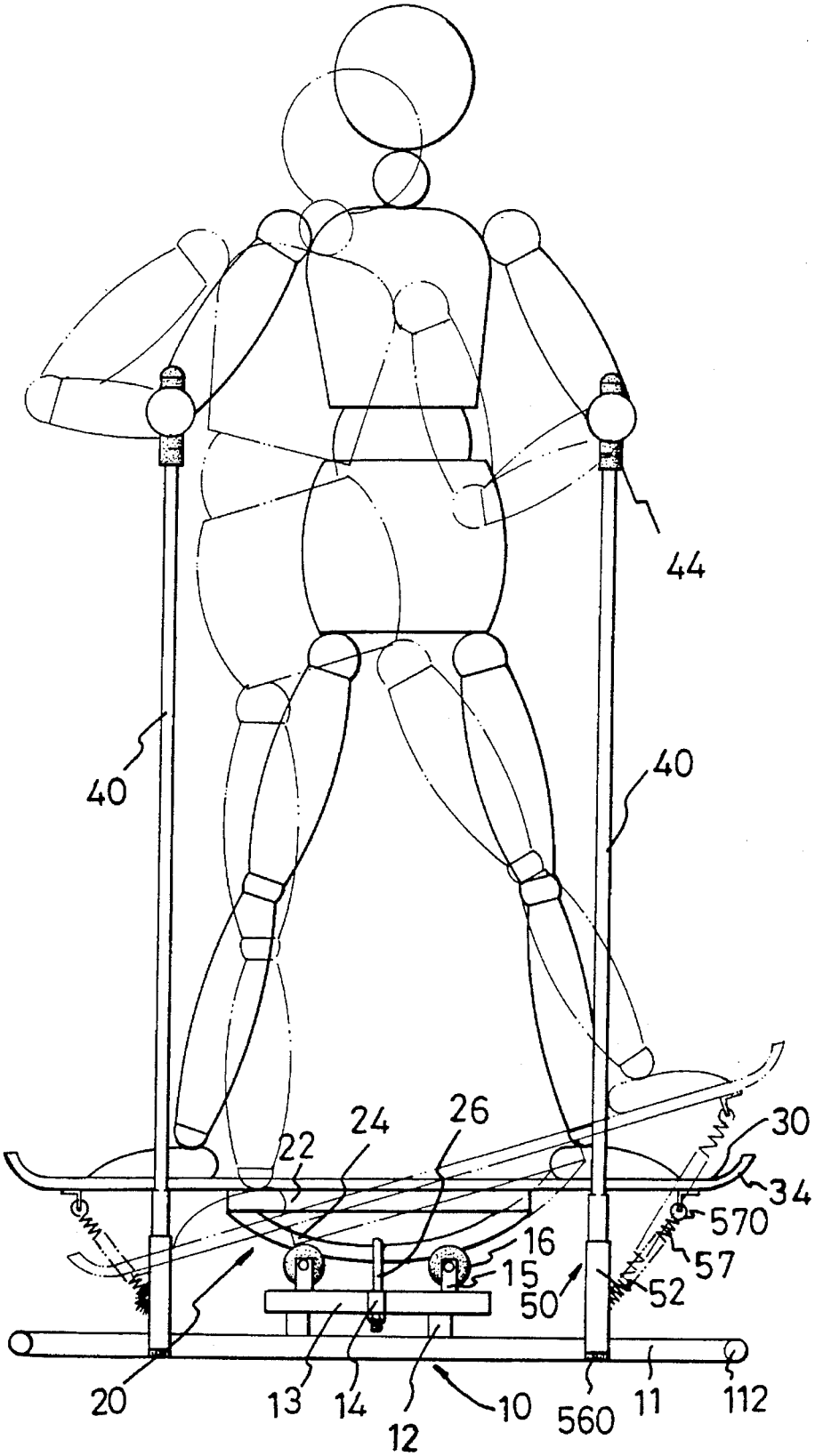
FIG. 5 is an operational view of the exerciser.

In operation, referring to FIGS. 1 and 5, a user can rock on the exerciser with his/her two feet stepping on the pedal board 30 and with his/her two hands grasping the two handgrip pads 44, thereby efficiently achieving the effect of exercising muscles of his/her waist and legs.

It should be clear to those skilled in the art that further embodiments of the present invention may be made without departing from the scope and spirit of the present invention.

What is claimed is:

1. An exerciser comprising:

a base member (10) including a plurality of supporting beams (13) each having two distal ends, a roller (16) rotatably mounted on each of the two distal ends of each of said plurality of supporting beams (13);

a rocking member (20) rotatably mounted on said base member (10) and including a plurality of arcuate tracks (24) each rotatably mounted between said rollers (16)

on each distal end of a corresponding one of said plurality of supporting beams (13); and a pedal board (30) fixedly mounted on said rocking member (20) to rotate therewith.

2. The exerciser in accordance with claim 1, wherein said base member (10) includes two base beams (11) mounted in parallel with each other, and a plurality of resting bars (12) each transversely mounted between said supporting beams (13) and said base beams (11).

3. The exerciser in accordance with claim 1, wherein said rocking member (20) includes a frame (22) fixedly mounted between said pedal board (30) and said plurality of arcuate tracks (24).

4. The exerciser in accordance with claim 1, wherein said rocking member (20) includes an inverted U-shaped brace (26) transversely mounted on said plurality of arcuate tracks (24).

5. The exerciser in accordance with claim 1, further comprising two positioning members (50) each having an outer fitting beam (51) transversely mounted on one end portion of said base member (10), an inner fitting beam (52) adjustably mounted in said outer fitting beam (51), and an upright post (56) formed on one distal end of said inner fitting beam (52), two vertical handles (40) each having a lower end (42) mounted on an upper end (55) of said upright post (56), and a handgrip pad (44) mounted on an upper end of each of said vertical handles (40).

6. The exerciser in accordance with claim 5, further comprising two retaining members (36) each fixedly and transversely mounted on one end portion of an underside of said pedal board (30), a plurality of biasing members (57) each having a first distal end (570) attached to each of said two retaining members (36) and a second distal end (572) attached to said outer fitting beam (51) of each of said two positioning members (50).

* * * * *